US005488983A

United States Patent [19]

Jung

[11] Patent Number: 5,488,983

[45] Date of Patent: Feb. 6, 1996

[54] ROLLER ASSEMBLY FOR CURTAINS AND THE LIKE

[75] Inventor: Claes V. Jung, Zug, Switzerland

[73] Assignee: Odin AG, Switzerland

[21] Appl. No.: 170,523

[22] Filed: Dec. 20, 1993

Related U.S. Application Data

[63] Continuation-in-part of Ser. No. 835,994, filed as PCT/SE90/00552, Aug. 29, 1990, abandoned.

[30] Foreign Application Priority Data

Aug. 30, 1989 [SE] Sweden ..... 8902868

[51] Int. Cl.[6] ..... E06B 9/20

[52] U.S. Cl. ..... 160/298; 160/319

[58] Field of Search ..... 160/319, 309, 160/313, 321, 323.1, 298, 299, 307, 308, 23.1

[56] References Cited

U.S. PATENT DOCUMENTS

| | | | |
|---|---|---|---|
| 1,321,674 | 11/1919 | Sheppard | 160/319 X |
| 4,323,105 | 4/1982 | Berman et al. | 160/319 X |
| 4,534,396 | 8/1985 | Jung | 160/319 X |
| 5,029,629 | 7/1991 | Cheng-Pei | 160/300 |

FOREIGN PATENT DOCUMENTS

| | | |
|---|---|---|
| 1811746 | 11/1969 | Germany . |
| 9103619 | 3/1991 | WIPO . |
| 9412758 | 6/1994 | WIPO . |

*Primary Examiner*—David M. Purol
*Attorney, Agent, or Firm*—Ladas & Parry

[57] ABSTRACT

A roller assembly for curtains and the like includes a rod jacket (1) on which the curtain is wound, a plate wheel (5), a fixed shaft (2), a chain wheel (3), plates (6) and a spring (7). The plate wheel (5) is mounted on the shaft (2) so as to enable it both to rotate and to be axially displaced relative to the shaft. Every second plate (6) is attached to the fixed shaft (2) and the others to the plate wheel (5). Furthermore, the plates (6) operate in such a way that they cannot rotate relative to the part to which they are attached, but can be axially displaced. The curtain is fixed by the spring (7) pressing the plate wheel (5) leftwards. The plates (6) lock the plate wheel (5) at the fixed shaft (2) because of the frictional action. When the height of the curtain is to be changed the chain wheel (3) is rotated in relation to the plate wheel (5). The plate wheel (5) is moved rightwards, because the contact area between the chain wheel (3) and the plate wheel (5) is saw-toothed. When the plate wheel (5) is moved rightwards against the action of the spring (7), the plates (6) will be moved apart to release friction force between them, whereby the height of the curtain can easily be changed.

5 Claims, 1 Drawing Sheet

ROLLER ASSEMBLY FOR CURTAINS AND THE LIKE

This application is a continuation-in-part of U.S. Ser. No. 07/835,994 filed Mar. 20, 1992, which is a completion of International Application PCT/SE90/00552 filed Aug. 29, 1990.

FIELD OF THE INVENTION

The present invention relates to a roller assembly for curtains, blinds or the like, including plates, in which the curtain may be brought to stop at an optional height, due to the frictional effect of the plates.

THE STATE OF THE ART

The spring mechanism for blinds, conventional in Sweden, was invented and patented in Canada about 100 years ago. When, about 30 years ago, tubes of steel, aluminum, and the like began to replace the wood rods previously used, it became possible to mount, instead of the spring mechanism, a side pulling mechanism, the blind being operable by a chain which drives a sprocket in the slide pulling mechanism.

Today, there are many different solutions to handle curtains by means of ball chains, bands, or the like, the locking of the height of the curtain usually occurring by means of the chain itself. In this connection, it is often a problem if the curtain is hanging in a public milieu, such as a hospital, a hotel, or the like, since it is not unusual that someone tries to adjust the height of the curtain by simply pulling the curtain cloth itself without observing there being a chain or the like. The height of the curtain being locked, such an action will more often than not result in the curtain being torn, leading to the curtains having to be changed at relatively close intervals. There is also a risk that the roller means will be destroyed by such a wrong handling.

There are also previously known roller means for curtains, operated by a chain or the like, which may be brought to stop at an optional height for the curtain. They basically work according to two different principles, which could be denoted the locking principle and the braking principle.

The locking principle means that the mechanism locks the curtain when the pull of the chain stops. As soon as the chain actuates the sprocket, the locking ceases and the blind may be rolled upwards or downwards. There is a disadvantage of this type of mechanism, i.e. once the mechanism is locked, there is no way of lowering the curtain by pulling it. Even at relatively limited force, either the curtain cloth or the mechanism will be destroyed, or even both.

The braking principle means that a brake is built in the mechanism. Hereby, the braking effect must be larger than the downward force of the blind. If the brake works permanently, i.e. both when the blind is rolled upwards and downwards, the force of the chain must overcome the sum of the weight of the curtain and the braking force. A bigger curtain requires relatively great braking force. Since the side pulling mechanism can only bear a limited force influence and the pulling force should not exceed 30N from the viewpoint of handling, the mechanisms with a permanent braking force have a limited use.

Moreover, previously known roller means of this kind usually works only in one direction, which means that either the roller must be placed on one side of the curtain, or two identical but reversed rollers must be manufactured for mounting on either side of the curtain.

SUMMARY OF THE INVENTION

Thus, it is an object of the present invention to provide a roller means that allows pulling the curtain cloth itself without breaking the curtain or the roller means. However, the means is intended to be regulated by a chain or the like.

Another object of the invention is to provide a roller means that can alternatively be placed to the left or to the right.

Yet another object of the present invention is to be able to stop the curtain at an optional height.

According to the invention these objects are achieved by a roller assembly including a rod jacket on which the curtain is rolled and a plate wheel fixed in the rod jacket, the plate wheel being journalled on a fixed shaft so as to enable it both to rotate and to be axially displaced relative to the shaft. Plates are arranged on both the shaft and the plate wheel and the frictional action between said plates is achieved by means of a spring. Upon operation of the sprocket, the plates are displaced from each other against the action of the spring, so that the curtain may be moved in a vertical direction, and when the sprocket stops, a braking action is achieved by means of the plates, which are once again pressed against each other by the spring.

The invention will appear more clearly by the following detailed description of an embodiment of the invention.

BRIEF DESCRIPTION THE DRAWINGS

DETAILED DESCRIPTION OF THE INVENTION

Figure 1:
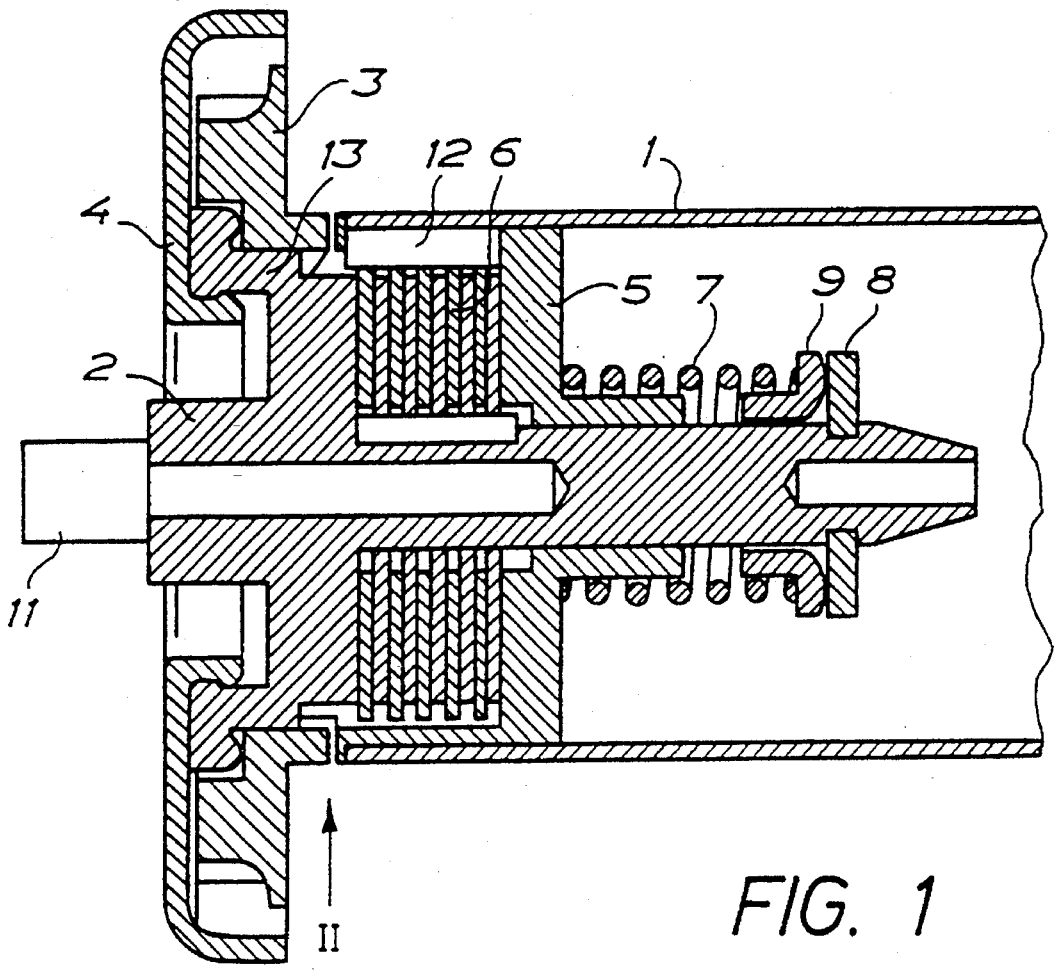
FIG. 1 is a cross-sectional view of the roller assembly according to the invention.

A preferred embodiment of the invention is shown with reference to the accompanying Figures.

The roller assembly comprises a rod jacket 1 fixed to the plate wheel 5, a fixed shaft 2 having a locking pin 11, a sprocket 3, a protecting cover 4, plates 6, a spring 7, and locking and controlling means 8, 9 for the spring 7.

The curtain, blind, or the like (not shown) is wound on the rod jacket 1. The shaft 2 is rigidly secured by the locking pin 11, or by means of splines, barbs, threads or the like. The locking pin is in turn attached to a bracket as is a conventional curtain. Thus, upon adjustment of the height of the curtain, the jacket 1 is to rotate relative to the fixed shaft 2. In order to hold the curtain in the desired position, the spring 7 presses the plate wheel to the left (as seen in the Figure), the plates 6 locking, by means of the frictional action, the plate wheel 5 at the fixed shaft 2.

The plate wheel 5 is journalled on the shaft 2 so as to enable it both to rotate and to be axially displaced relative to the shaft. The movement between the plate wheel and the shaft may be arranged e.g. by adjusting the fitting between the plate wheel 5 and the shaft 2 so as to allow a relative movement between said two parts, whereby the contact surfaces should have a low mutual friction. The spring 7 and the sprocket 3 will limit the movement of the plate wheel along the shaft. The plates 6 are respectively alternatively attached to the shaft 2 and the plate wheel 5. The plates 6 have recesses for accommodating locking pins 12 such that the pins 12 respectively secure the alternate plates 6 on the shaft 2 and the plate wheel 5. The plates 6 operate in such a way that they cannot rotate relative to the part to which they are attached, but can be axially displaced relative thereto. The spring 7 is journalled round the shaft 2 between the plate wheel 5 and a lock washer 8 attached to the shaft. Furthermore, the plate wheel 5 has an axially projected guide portion for positioning the spring 7 around the shaft 2. There is a corresponding guiding member 9 opposite the projected guide portion, thereby positioning another end of the spring 7 on the shaft 2. The guiding member 9 is provided against the lock washer 8.

The operating chain or the like (not shown) runs around the chain wheel 3, this chain wheel 3 being rotatably mounted on the shaft 2. In order to protect the roller assembly and to keep the chain in place, a protecting cover 4 is attached over the chain wheel 3.

Furthermore, the fixed shaft 2 has a radially extended portion 13 which supports the chain wheel 3. The plates 6 are supported between the extended portion 13 and the plate wheel 5.

Figure 2:
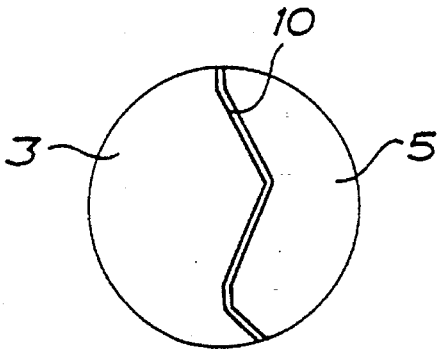
FIG. 2 is an enlarged partial view of the contact area between the chain wheel and the plate wheel of the roller assembly as viewed at the spot in the direction of the arrow II shown in FIG. 1.

FIG. 2 shows an enlarged partial view of the contact area 10 between the chain wheel 3 and the plate wheel 5 when the roller assembly is in a rest position. The chain wheel 3 and the plate wheel 5 have respectively a saw-tooth contact surface. In the rest position shown in FIG. 2, the plate wheel cannot rotate due to the friction forces between the plates 6. If the chain wheel 3 is rotated in either direction by pulling the chain (not shown), the peaks of the saw-tooth surface of the chain wheel 3 will move upwards or downwards away from the troughs of the saw-tooth surface of the plate wheel 5 as presently shown in FIG. 2. The rotation of the chain wheel 3 thus forces the plate wheel 5 to displace rightwards. The displacement of the plate wheel 5 is made against the action of the spring 7.

In order to change the height of the curtain, a chain or the like (now shown) running round the chain wheel 3, is normally pulled. The chain wheel 3 will then rotate relative to the plate wheel 5, the plate wheel 5, thanks to the saw-toothed contact area 10, being displaced rightwards (as seen in FIG. 1) against the action of the spring 7. When the plate wheel 5 is displaced rightwards on the shaft, the locking frictional action between the plates 6 will be released, due to the fact that they are displaceably supported in relation to the shaft 2 and the plate wheel 5, respectively. It is easy to move the curtain vertically in this position, and when the desired height has been reached the chain wheel is brought to a stop, the spring bringing the plate wheel back leftwards for contact with the chain wheel 3 along the saw-toothed contact area 10. The plates 6 will then once again be pressed together between the plate wheel 5 and the extension 13 of the shaft 2, whereby the curtain is fixed by the frictional action between the plates 6.

If someone unintentionally pulls at the curtain itself, the friction from the plates 6 must first be overcome, which they have been constructed to stand. Thus, the roller assembly will not be destroyed by such an incorrect handling.

By appropriately choosing the number of plates 6 and their material, the roller assembly may be adapted after the given conditions relating to the weight, the size, and such, of the curtain.

I claim:

1. A roller assembly for curtains and blinds, comprising a rod jacket on which the curtain is wound, a plate wheel fixed to the rod jacket and mounted on a fixed shaft, a plurality of plates arranged alternatively on the fixed shaft and the plate wheel, whereby every second plate of said plates is attached to the fixed shaft and the others are attached to the plate wheel, the plate wheel being mounted on the shaft so that the plate wheel is rotatable when being axially displaced relative to the shaft, a chain wheel mounted on the shaft and abutting the plate wheel, each of which wheel has a saw-tooth contact surface thereby forming a contact area therebetween whereby the plate wheel is axially displaced away from the abutting chain wheel against a spring when the chain wheel rotates, and whereby locking frictional action between the plates will be reduced or eliminated.

2. The roller assembly according to claim 1, wherein the plates have a recess for a locking pin, whereby the plates are unable to rotate relative to the shaft or the plate wheel to which they are respectively attached, but may be axially displaced.

3. The roller assembly according to claim 1, wherein the spring is arranged so as to press the plates together.

4. The roller assembly according to claim 1, wherein the strength of the spring and the number of plates are selected for various curtains of different weight and size.

5. The roller assembly according to claim 1, wherein chain runs around the chain wheel to control the height of the curtain.

* * * * *